United States Patent [19]

Smerz

[11] Patent Number: 4,745,533

[45] Date of Patent: May 17, 1988

[54] MULTI-LAMPHOLDER AND ACCESSORY RETAINMENT SYSTEM

[75] Inventor: Frank G. Smerz, Addison, Ill.

[73] Assignee: Cooper Industries, Houston, Tex.

[21] Appl. No.: 6,835

[22] Filed: Jan. 27, 1987

[51] Int. Cl.[4] ..... F21V 17/00

[52] U.S. Cl. ..... 362/364; 362/440

[58] Field of Search ..... 362/364, 365, 368, 396, 362/440, 433, 226

[56] References Cited

U.S. PATENT DOCUMENTS

| | | | |
|---|---|---|---|
| 1,931,343 | 10/1933 | Cook et al. | 362/364 |
| 3,233,088 | 2/1966 | McDonald | 362/364 |
| 3,518,420 | 6/1970 | Kripp | 362/365 |
| 3,609,346 | 9/1971 | Lund et al. | 362/364 |
| 3,683,173 | 8/1972 | Guth | 362/364 |
| 4,327,403 | 4/1982 | Capostagno et al. | 362/368 |

FOREIGN PATENT DOCUMENTS

| | | | |
|---|---|---|---|
| 2208092 | 6/1974 | France | 362/364 |

*Primary Examiner*—Charles J. Myhre
*Assistant Examiner*—David A. Okonsky
*Attorney, Agent, or Firm*—Eddie E. Scott; A. R. Thiele

[57] ABSTRACT

A recessed lighting fixture includes a lamp and accessory retainment spring which has a lower resilient portion for holding a first size lamp, a central mounting portion and an upper resilient portion for holding a second size lamp. The lower resilient portion may be used for mounting a lighting accessory when a second size lamp is located in the upper resilient portion.

20 Claims, 4 Drawing Sheets

MULTI-LAMPHOLDER AND ACCESSORY RETAINMENT SYSTEM

BACKGROUND OF THE INVENTION

The present invention pertains to lighting fixtures, more particularly the present invention pertains to recessed lighting fixtures incorporating internal lamp mounting means for a variety of lamp styles.

Recessed lighting fixtures have become popular for use in residential and business locations. One drawback of such recessed lighting fixtures is that once selected only one style of lamp is useable therein. If the user of the recessed lighting fixture decides to change the style of lamp utilized, it then becomes necessary to change the entire recessed lighting fixture. Such switching of recessed lighting fixtures can become expensive and extremely difficult to accomplish. There is therefore a need to provide a recessed lighting fixture which allows for changing the style of lamps utilized with the recessed lighting fixture.

There is also a need to provide for the use of various accessories such as colored filters or lenses. Besides providing for the mounting of various style lamps, the recessed lighting fixture should also enable the mounting of lighting accessory devices.

SUMMARY OF THE INVENTION

The multi-lampholder and accessory retainment system of the present invention provides for the mounting of various styles of lamps and lighting accessories by the use of a unique lamp and accessory retainment spring.

The lamp and accessory retainment spring of the present invention includes three portions; a lower resilient portion, a central portion and an upper resilient portion. The lower resilient portion is constructed in substantially the form of a V to hold a first style of lamp. Above the lower resilient portion is the central portion which provides for mounting of the spring to the recessed lighting fixture. Above the central mounting portion is formed the substantially U shaped upper resilient portion which is designed to hold a second style of lamp. When the upper resilient portion of the spring is used, a lighting accessory such as a light diffuser, a filter or a lens may be mounted in the lower resilient portion.

BRIEF DESCRIPTION OF THE DRAWINGS

A better understanding of the multi-lampholder and accessory retainment system of the present invention may be had by reference to the drawings wherein.

DETAILED DESCRIPTION OF THE EMBODIMENTS

Figure 1:
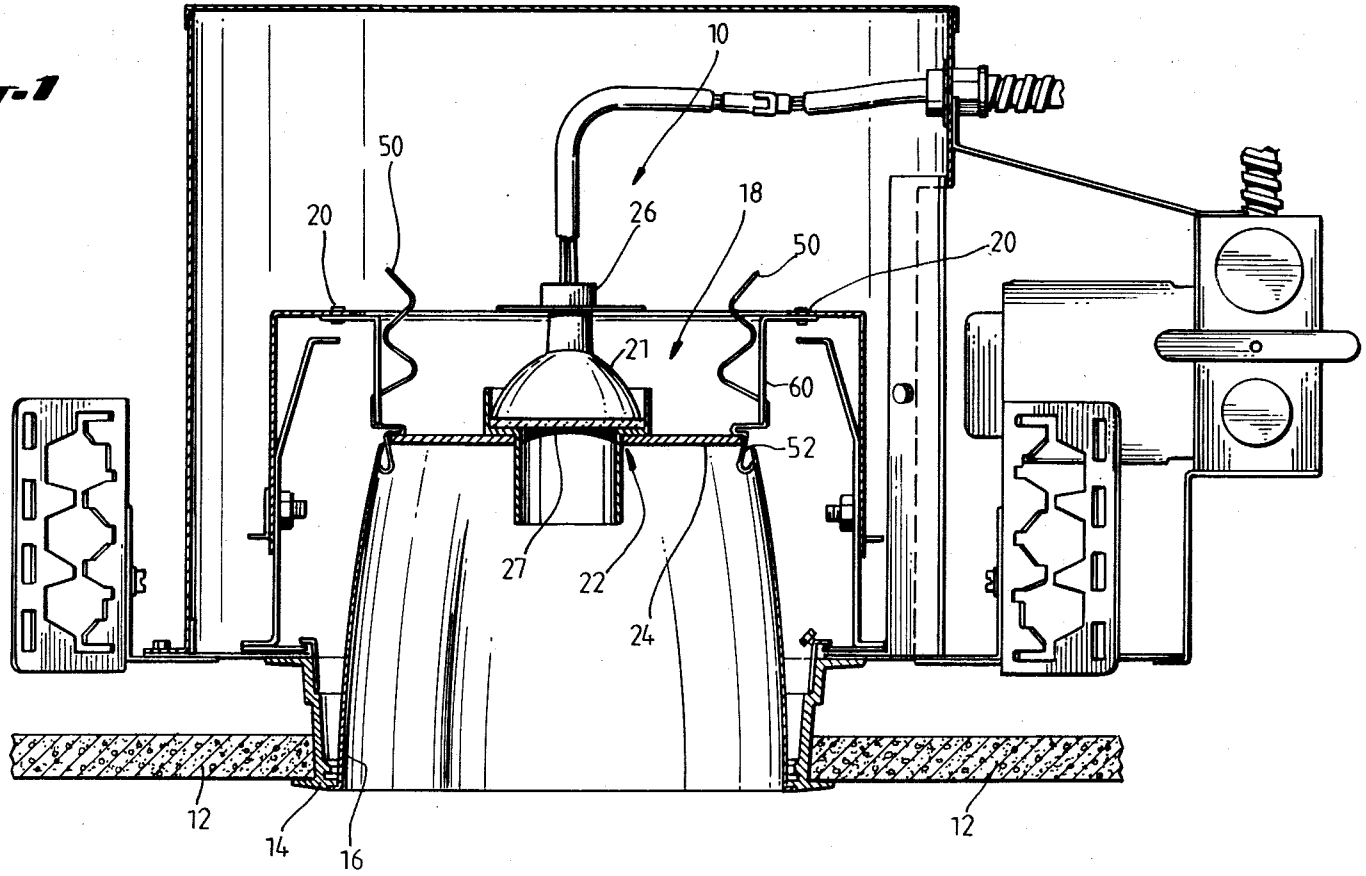
FIG. 1 is a front elevational view in partial section of a recessed lighting fixture showing utilization of the multi-lampholder and accessory retainment system of the present invention.
Figure 2:
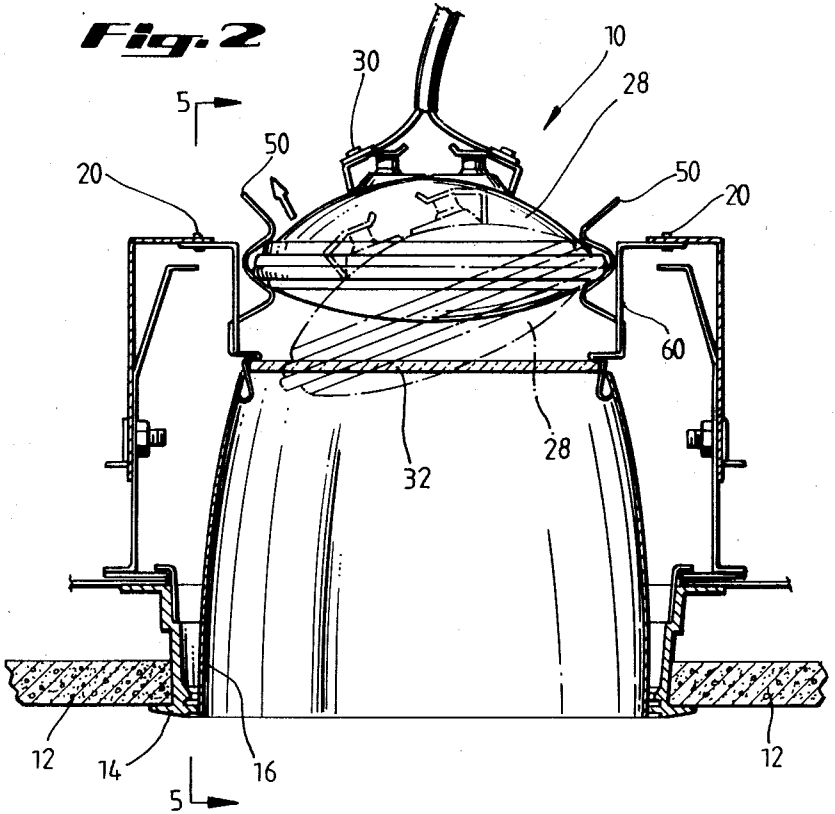
FIG. 2 is a front elevational view in partial section of a recessed lighting fixture showing utilization of the multi-lampholder and accessory retainment system with a second size lamp and lighting accessory.

As may be seen in FIGS. 1 and 2 recessed lighting fixture 10 is designed for mounting in ceiling 12. Attached to the bottom of fixture 10 is trim 14 which provides the attractive appearance for fixture 10 when observed from below. Above the level of ceiling 12 is canister 16 having a reflective lining which canister typically includes means for mounting the fixture to the ceiling and means for mounting and providing electrical current to a lamp. The mechanical assembly for holding a lamp is found at the upper portion of the canister shown generally by reference number 18.

Figure 6:
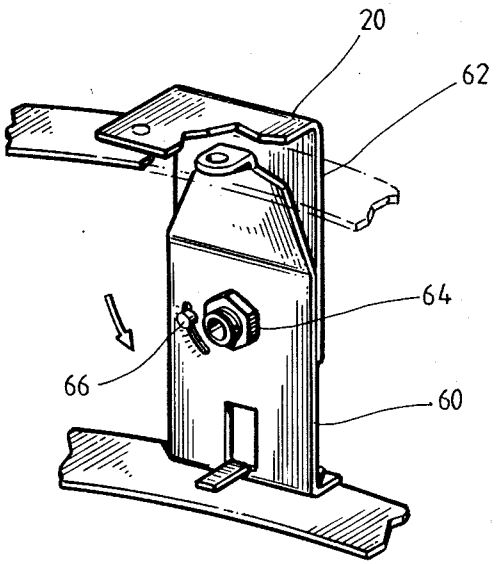
FIG. 6 is a perspective view of the tilting side bracket.

In the multi-lampholder and accessory retainment system of the present invention tilting side brackets 20 are used to mount the mechanical assembly for a holding a lamp in recessed lighting fixture 10. The operation of tilting side brackets 20 will be explained below with reference to FIGS. 5 and 6.

To illustrate how the system of the present invention holds two separate size of lamps, it must be understood that a small lamp 21 or mini lamp of the type generally designated as MR16 lamp manufactured by General Electric can be mounted in assembly 22. Assembly 22 is characterized by a disk 24 which centers lamp 21 with respect to cansiter 16. Power is supplied to mini-lamp 21 through socket 26. Lens 27 may be used to diffuse the eminated light.

The mounting of a larger lamp such as a PAR 36 lamp 28 manufactured by General Electric in canister 16 is shown in FIG. 2. It may be seen that PAR 36 lamp 28 is held in the uppermost portion of lighting fixture 10. Power is supplied to lamp 28 through connections 30. As may be seen in the central portion of fixture 10 it is also possible to employ a lighting accessory such as a louver lens, or a colored filter 32 in the lower portion of retaining spring 50 when a PAR 36 lamp 28 is employed. The phantom outline of PAR 36 lamp 28 illustrates how the lamp is inserted into retaining spring 50.

Figure 3:
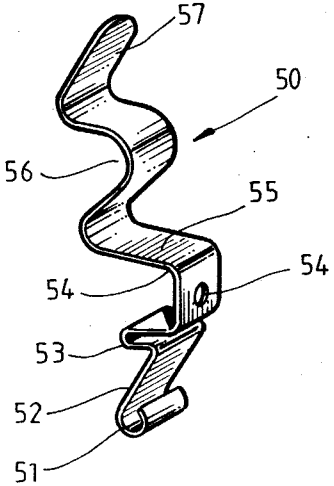
FIG. 3 is a perspective view of the lamp and accessory retainment spring.
Figure 4:
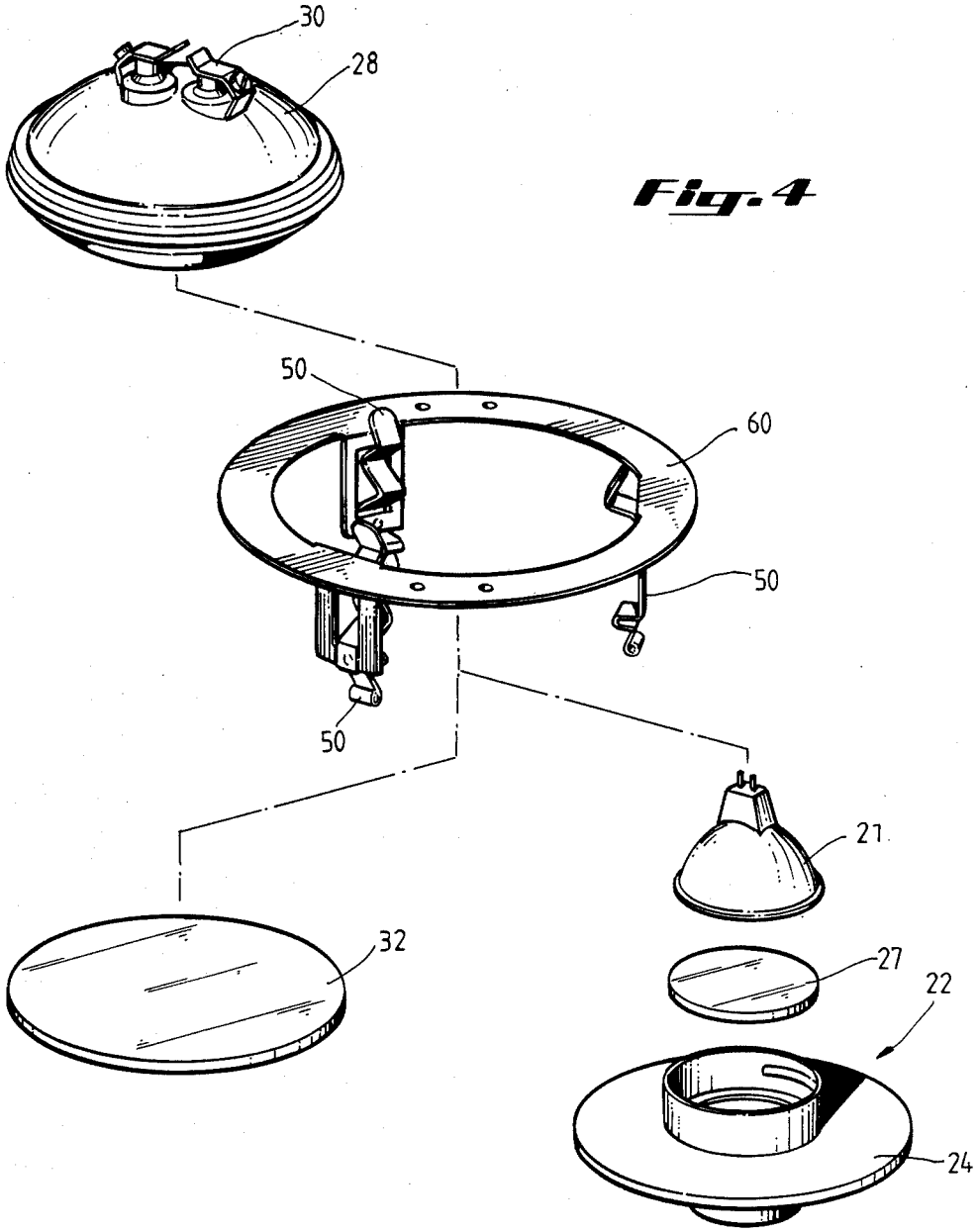
FIG. 4 is an exploded perspective view of the lamp and accessory retainment system in its two alternate configurations.

It is retaining spring 5 which forms the core of the present system. A better understanding of how retaining spring 50 enables the mounting of two different size lamps is obtained by reference to FIG. 3. Therein it may be seen that lower portion 52 of retaining spring 50 is formed in a V-shape. This V-shape also provides for the formation of a curled portion 51 which is as seen in FIGS. 1 and 2 and facilitates the mounting of disc 29 or accessory 32. On the opposite side of lower portion 52 from curled portion 51 is ledge 53. It is ledge 53 which provides a stop for mounting of disk 24 as shown in FIG. 1 or lighting accessory 32 as shown in FIGS. 2 and 4. A plurality of retaining springs 50 are used with recessed lighting fixture 10. While two retaining springs 50 are shown in FIGS. 1 and 2 and three springs 50 are shown in FIG. 4 it is to be understood that any number of springs 50 may be used without affecting the operability of lighting fixture 10.

Central to lamp retaining spring 50 is mounting portion 54. As may be seen in FIGS. 1 and 2 mounting portion 54 includes a hole 54' through which a fastener may pass for attachment of lamp retaining spring 50 to tiltable frame 60 in recessed lighting fixture 10. Emanating from central portion 54 is extension 55 which locates upper resilient portion 56 of lamp retaining spring 50. As may be seen in FIG. 3 upper resilient portion 56 is formed in the shape of a U. Optionally, if desired, tab 57 may extend upwardly from upper resilient portion 56. It is upper resilient portion 56 which is used to retain PAR 36 lamp 28 in place as shown in FIG. 2.

Figure 5:
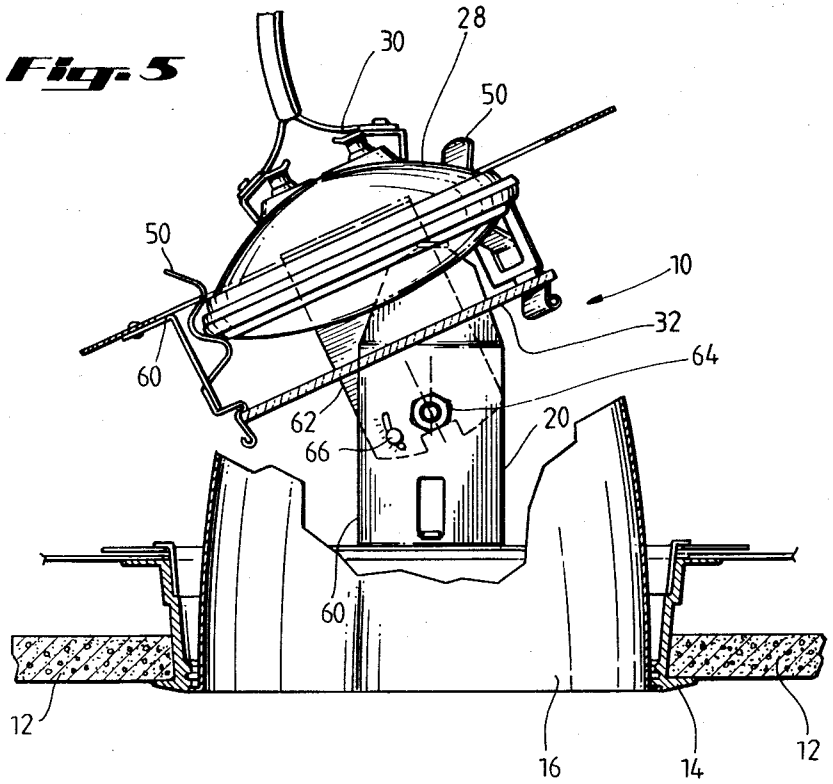
FIG. 5 is a view along line 5—5 of FIG. 2.

Retainment spring 50 is mounted to tiltable frame 60 which in turn is mounted to brackets 20 within recessed lighting fixture 10. As may be seen by reference to FIGS. 5 and 6 bracket 20 has a stationary piece 60 and a movable piece 62. Stationary piece 60 and movable piece 62 are connected by fastener and nut combination 64. Gage pin 66 is used to show the degree of tilt of tiltable frame 60. FIG. 5 illustrates how frame 60 is tilted with respect to cannister 16.

Lamp 28 may be inserted in U-shaped portions 56 either from above or from below as shown in FIG. 2. The resilient nature of spring 50 facilitates the insertion of lamp 28 into U-shaped portion 50.

OPERATION

When mounting mini-lamp 21 against ledge 53 of spring 50 it may be seen that such mounting can be accomplished by placing disk 24 within V-shaped portion 52 of retainment spring 50 thereby causing mechanical assembly 22 to be retained within lighting fixture 10. While the multi-lampholder and accessory retainment system of the present invention is shown as mounting only two exemplary styles of lamps, it will be understood that a variety of other lamp and accessory mounting configurations may be obtained by altering the shape of the bends in either lower portion 52 or upper portion 56 of retainment spring 50.

Lamp retainment spring 50 of the present invention may be made from annealed steel, however, it is understood that other materials similar in properties to annealed steel may be used without departing from the scope of the present invention.

There is now taught by the present invention a system for mounting different sizes of lamps and lighting accessories within a recessed lighting fixture.

While the foregoing invention has been described in terms of its preferred embodiment it will be understood that the present invention is not to be limited by the foregoing disclosure but rather is to be defined only by the scope of the appended claims as interpreted by one of ordinary skill in the art.

I claim:

1. A multi-lampholder and accessory retainment system for use in a recessed lighting fixture, said system comprising:
- mounting supports contained within said recessed lighting fixture; and
- a retainment spring affixed to a respective one of each of said mounting supports, said retainment spring having:
- a lower resilient portion constructed and arranged to hold a first style of lamp;
- a central mounting portion constructed and arranged for attachment to said respective mounting support; and
- an upper resilient portion constructed and arranged to hold a second style of lamp.

2. The system as defined in claim 1 wherein said lower resilient portion of said retaining spring has a curled end.

3. The system as defined in claim 2 wherein said lower resilient portion of said retaining spring is formed substantially in the shape of a V.

4. The system as defined in claim 3 wherein said upper resilient portion of said retaining spring is formed substantially in the shape of a U.

5. The system as defined in claim 4 further including a tab projecting from said upper resilient portion of said retaining spring.

6. The system as defined in claim 5 wherein said lower resilient portion of said retaining spring is further constructed and arranged to mount a lighting accessory when a second style of lamp is mounted in said upper resilient portion.

7. The system as defined in claim 1 wherein said upper resilient portion of said retaining spring is substantially formed in the shape of a U.

8. The system as defined in claim 7 wherein said lower resilient portion is further constructed and arranged to mount a lighting accessory when a second style of lamp is mounted in said upper resilient portion.

9. A recessed lighting fixture comprising:
- a canister;
- a reflective surface contained within said canister;
- means for holding a light source in position with respect to said canister and said reflector, said means for holding a light source in position with respect to said canister and said reflective surface including a plurality of retainment springs having:
  - a lower resilient portion constructed and arranged to hold a first style of light source;
  - a central mounting portion constructed and arranged for attachment to said means for holding the light source in position with respect to said canister;
  - an upper resilient portion constructed and arranged to hold a second style of light source.

10. The recessed lighting fixture as defined in claim 9 wherein said lower resilient portion of said retainment springs further including a curled section extending therefrom.

11. The recessed lighting fixture as defined in claim 10 wherein said lower resilient portion of said retaining spring is formed substantially in the shape of a V.

12. The recessed lighting fixture as defined in claim 11 wherein said upper resilient portion of said retaining spring is formed substantially in the shape of a U.

13. The recessed lighting fixture as defined in claim 12 wherein said upper resilient portion of said retaining spring further includes a tab extending upwardly therefrom.

14. The recessed lighting fixture as defined in claim 13 wherein said lower resilient portion is further constructed and arranged to mount lighting accessories when a first style of lamp is placed in said upper resilient portion.

15. The recessed lighting fixture as defined in claim 9 wherein said upper resilient portion is formed substantially in the shape of a U.

16. The recessed lighting fixture as defined in claim 15 wherein said lower resilient portion is further constructed and arranged to mount lighting accessories when a second style of lamp is mounted in said upper resilient portion.

17. A recessed lighting fixture comprising:
- a light source;
- a canister;
- a reflective surface mounted in said canister;
- means for holding said light source in position with respect to said canister and said reflective surface, said means for holding said light source in position with respect to said canister and said reflective surface including a plurality of lamp retainment springs having:

a lower resilient portion constructed and arranged to mount a first style of lamp;

a central mounting portion constructed and arranged for affixation to the sides of said canister; and an upper resilient portion constructed and arranged to hold a second style of lamp.

18. The recessed lighting fixture as defined in claim 17 further including means for mounting said light source in said retainment spring.

19. The recessed lighting fixture as defined in claim 18 wherein said means for mounting said light source in said retainment spring is a disc.

20. The recessed lighting as defined in claim 17 wherein said means for holding said light source is tiltable with respect to said canister and said reflective surface.

* * * * *